US006199851B1

(12) United States Patent
Latvakangas et al.

(10) Patent No.: US 6,199,851 B1
(45) Date of Patent: Mar. 13, 2001

(54) METHOD, DEVICE AND ACCESSORIES FOR THE MANUFACTURE OF BOOKLETS

(75) Inventors: Urpo Latvakangas, Saltsjo-Boo; Jan Sabelstrom, Huddinge, both of (SE)

(73) Assignee: Bindomatic AB, Stockholm (SE)

( * ) Notice: Subject to any disclaimer, the term of this patent is extended or adjusted under 35 U.S.C. 154(b) by 0 days.

(21) Appl. No.: 09/117,080

(22) PCT Filed: Jan. 22, 1997

(86) PCT No.: PCT/SE97/00111

§ 371 Date: Mar. 24, 1999

§ 102(e) Date: Mar. 24, 1999

(87) PCT Pub. No.: WO97/27067

PCT Pub. Date: Jul. 31, 1997

(30) Foreign Application Priority Data

Jan. 22, 1996 (SE) ..... 9600227

(51) Int. Cl.[7] ..... B42C 1/100; B65H 1/00

(52) U.S. Cl. ..... 270/58.08; 270/37; 412/4; 412/8; 412/9; 412/19; 412/20; 412/24; 412/902

(58) Field of Search ..... 271/145; 270/58.07, 270/58.08, 37; 412/4, 5, 6, 8, 9, 19, 20, 24, 902

(56) References Cited

U.S. PATENT DOCUMENTS

| | | | | |
|---|---|---|---|---|
| 5,053,814 | * | 10/1991 | Takano et al. | 271/145 X |
| 5,067,835 | * | 11/1991 | Yamamoto et al. | 271/145 X |
| 5,140,380 | * | 8/1992 | Nakamura et al. | 270/58.07 X |
| 5,570,985 | * | 11/1996 | Latvakangas et al. | 412/4 |
| 5,868,539 | * | 2/1999 | Rathert | 412/5 |
| 5,881,352 | * | 3/1999 | Kobayashi et al. | 270/37 X |
| 5,931,624 | * | 8/1999 | Naruse | 412/84 |
| 6,027,107 | * | 2/2000 | Natsume et al. | 270/58.07 X |

FOREIGN PATENT DOCUMENTS

WO 94/26535 * 11/1994 (WO) .

* cited by examiner

*Primary Examiner*—Christopher P. Ellis
*Assistant Examiner*—Patrick Mackey
(74) *Attorney, Agent, or Firm*—Cooper & Dunham LLP

(57) ABSTRACT

The present invention relates to a method, a device for assembling and producing of booklets. Each booklet having a cover that comprises two cover sheets and a spine disposed inbetween. A glue string is applied to the inner surface of the spine, and a sheet bundle inserted between the cover sheets of said cover and affixed at one end side edge to the inner surface of the spine by means of the glue string.

31 Claims, 4 Drawing Sheets

METHOD, DEVICE AND ACCESSORIES FOR THE MANUFACTURE OF BOOKLETS

FIELD OF INVENTION

According to a first aspect, the present invention relates to a booklet production method of the kind defined in the preamble of Claim 1. According to a second and a third aspect, the invention relates to a device for carrying out the method, of the kind defined in the respective preambles of Claims 14 and 19. According to a fourth aspect, the invention relates to accessories of the kind defined in the preamble of Claim 25 for use with said device and for carrying out said method.

Booklets of this kind are comprised of a cover having two cover sheets and a spine therebetween, a glue string applied to the inner surface of the spine, and a bundle or set of sheets enclosed between the two cover sheets with one edge of the sheet bundle affixed to the inner surface of the spine by means of the glue string.

DESCRIPTION OF THE BACKGROUND ART

Booklets of the aforedescribed kind are normally produced in the following way.

A flat sheet of board and/or plastic is folded to provide a cover that comprises two cover sheets and a spine located therebetween. A string of melt glue is applied to the inner surface of the spine, wherein the glue melts when heated and solidifies and adheres to said inner surface as it cools. The cover sheets are then folded towards one another to form a cover with the glue string located between the sheets. The finished covers are then packed and delivered to the user, who removes a cover from the package and inserts a bundle of sheets between the cover sheets with one side edge of the sheets in abutment with the glue string. The user then places the cover and enclosed sheets in a binding apparatus, e.g. of the kind described in SE-B 434 367, so as to bring the outer surface of the spine into contact with a hot plate. The glue melts within a given space of time and the bundle of sheets sinks down into the molten glue. The user then removes the cover and sheet bundle from the apparatus and allows the glue to cool, so as to firmly affix the edges of the sheets to the spine.

The aforedescribed method is both complicated and time-consuming, particularly when a large number of booklets of one and the same kind or of different kinds shall be produced.

U.S. Pat. No. 5,102,277 teaches a method and a machine for binding bundles or sets of sheets in covers of the aforedescribed kind. Although the method and the machine described are developments of the manual binding of sheets achieved with binding apparatus according to SE-B 434 367, the method and machine do not enable bundles of sheets, e.g. dispensed from a copier, to be combined with the empty covers that are introduced into the machine in bundles.

U.S. Pat. No. 2,549,890 teaches a bookbinding machine. Book blocks are provided with glue on their respective side surfaces and introduced into covers that fall down singly from a magazine in the machine. The machine thus produces products of a kind other than booklets, wherein each product consists of a cover that is affixed to a sheet bundle solely at the spine of the cover. Moreover, the machine does not include means for activating a glue string so as to affix the bundle of sheets to the cover spine.

GB-A 1 258 746 teaches a bookbinding machine for producing book blocks by applying melt glue along one edge of the book block. The machine thus produces products of a kind other than booklets which comprise of bundles of sheets affixed to the spines of the booklets. Moreover, this machine does not include sheet-bundle and booklet transporting means.

U.S. Pat. No. 3,093,396 teaches a bookbinding machine in which paper sheets are joined together along one side edge thereof by means of several adhesive layers, such as to form a book block. Each book block is then combined with a cover that lacks a binding agent. The adhesive layers on the book block are then activated via the cover spine, to join the block to the spine. The machine thus produces products of a kind other than booklets that consist of covers having spine-applied glue strings that are interconnected with bundles of sheets which are loose relative to one another prior to binding. Moreover, the covers are not collected in any form of cassette or the like from which they are transported to book blocks in the known machine.

WO 94/26 535 teaches a method and a device which constitutes a step forwards in relation to the aforedescribed techniques, wherewith the manual work is reduced, the production rate is increased, and the quality of the finished booklets improved. This has been achieved with the method and the device according to this publication by virtue of a method that comprises the steps of

- moving a sheet bundle to a first position by means of a first power-driven transporter means;
- moving by means of a second power-driven transporter means one cover from a plurality of covers that include a glue string and that are placed in the immediate vicinity of one another to a second position in which said one cover is distanced from the remaining covers;
- combining the sheet bundle with the glue-string provided cover such as to enclose said bundle in said cover with said side edge of the sheet bundle facing the glue string; and
- moving the cover and the enclosed sheet bundle past an activator that functions to activate the glue string so as to bind said side edges of said bundle to the inner surface of the spine.

The device for carrying out the described method comprises

- a first power-driven transporter means for moving a sheet bundle to a first position with the sheets in a mutually non-bound state;
- a second power-driven transporter means for moving a cover that includes a glue string to a second position distanced from a plurality of covers that include glue strings and that are placed in the immediate vicinity of one another;
- an assembly means for combining the sheet bundle with said cover provided with a glue string;
- movable pick-up means for picking up the cover provided with said glue string and said sheet bundle, with the side edges of the sheet bundle in abutment with the glue string; and
- activator means for activating the glue string during movement of either the pick-up means or the activator means, so as to bind the side edges of the sheet bundle with the inner surface of the spine.

Although the apparatus described in WO 94/26 535 solves many problems related to apparatus of the kind concerned, there is still room for further improvement. In the case of the known apparatus, the covers are placed in an obliquely positioned cassette. As a result of the combined effect of the intrinsic weight of the covers, the spring force exerted by the half-open covers and the uneven bias of these forces, the friction between the covers and between said covers and the cassette makes it difficult to take a cover from the cassette, which is liable to result in disturbances in operation.

Another problem with such apparatus and such a method is associated with the desire to bind booklets of mutually different thicknesses, depending on the number of sheets or leaves in the bundle to be bound. Bundles of different thicknesses require different types of folders which can vary primarily with respect to the thickness of the spine. Thus, a given cover will correspond to a given range of sheet bundle thicknesses. When the wrong cover is used for a given sheet bundle, the result will be unsatisfactory. Consequently, it is desirable to improve the aforesaid binding method in a way which will eliminate this problem.

The object of the present invention is to overcome these problems, i.e. to facilitate collection of a cover from its magazine and to avoid a wrong combination between bundle thickness and the cover used.

This object is achieved in accordance with a first aspect of the invention by a method of the kind defined in the preamble of Claim 1 and having the characteristic features set forth in the characterizing clause of said Claim.

According to a second aspect of the invention, the object has been achieved with apparatus of the kind defined in the preamble of Claim 14 and having the characteristic features set forth in the characterizing clause of said Claim.

According to a third aspect of the invention, the object has been achieved with apparatus of the kind defined in the preamble of Claim 19 and having the characteristic features set forth in the characterizing clause of said Claim.

According to a fourth aspect of the invention, the object is achieved with the aid of an accessory in the form of a cassette of the kind defined in the preamble of Claim 24 and having the characteristic features set forth in the characterizing clause of said Claim.

Because the covers are positioned vertically in the readiness position, the least possible friction will be generated when removing the covers from the magazine, therewith facilitating this stage of the process and avoiding the aforesaid problem in this respect. The risk of using a wrong cover can be eliminated by code-marking the covers or the cassette in which the covers are stored and then comparing the code with the thickness of the sheet bundle concerned.

Preferred embodiments of the inventive method, apparatus and accessory are set forth in respective dependent Claims.

The invention will now be described in more detail with reference to preferred embodiments thereof and also with reference to the accompanying drawings, in which FIG. 1 is a schematic side view of earlier known apparatus;

As before mentioned, the inventive apparatus is a further development of the technology earlier described in prior publication WO 94/26 535. The illustrated embodiment has much in common with the prior art apparatus, and consequently there will be given initially a detailed description of this apparatus.

Figure 1:
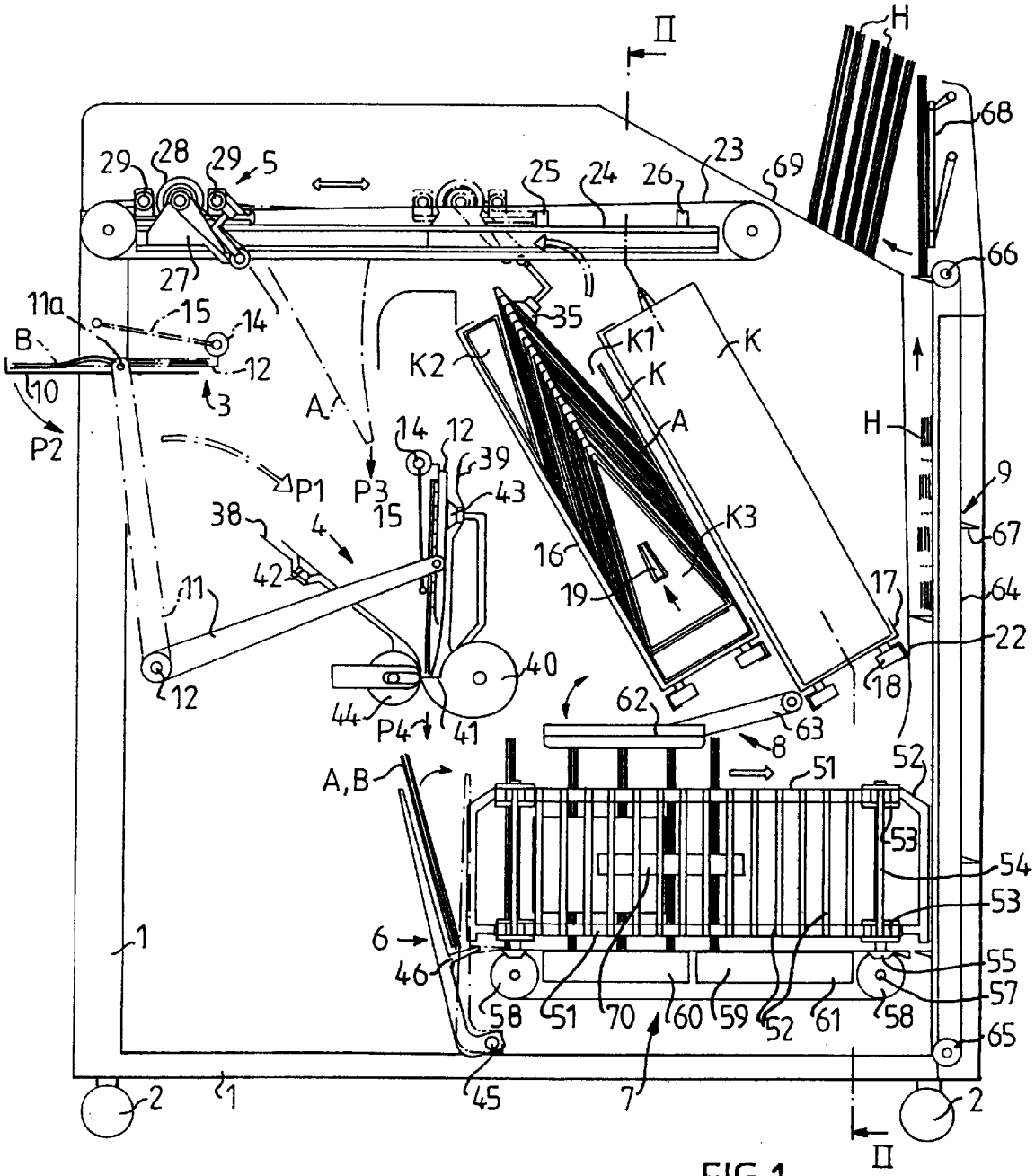

The apparatus shown in FIG. 1 is incorporated in a machine that includes a stand 1 and wheels 2. The main machine components consist of a device in the form of a platform 10 that receives a bundle of sheets B, which are loose in relation to one another, arriving from a copier or (laser) printer (not shown), a device 3 that transports sheet bundles to an assembling device 4, a device 5 for picking covers A from a cassette K and transporting the covers singly to the assembling device 4, a device 6 for collecting assemblies from the assembling device 4 for activation of a binding agent on the spine of each cover A so as to bind the bundle of sheets in the cover to the spine thereof, a sheet jogging device 8 for straightening the sheets as the covers pass through the activator means 7, and a device 9 for transporting from the machine booklets H consisting of sheet bundles B bound to covers A.

The sheet bundle transporting device 3 includes a plate 12 which can be inserted between the platform 10 and a sheet bundle B resting thereon and which is journalled at 11*a* on an arm 11 which is, in turn, journalled at 12 and caused to swing backwards and forwards by a driven arrangement not shown. The arrow P1 indicates this swinging movement in one direction (clockwise). The plate 12 is also caused to swing backwards and forwards on the arm 11 by a drive arrangement not shown. This swinging movement is shown in one direction by the arrow P2 (anti-clockwise). A holding device 15 is journalled on the plate 12 at 14 and is swung by drive means (not shown) between a position in which the holding device firmly presses a sheet bundle B lying on the plate 12, as shown in full lines in FIG. 1, and a position in which the holding device is spaced from the sheet bundle, as shown in chain lines in FIG. 1.

Figure 2:
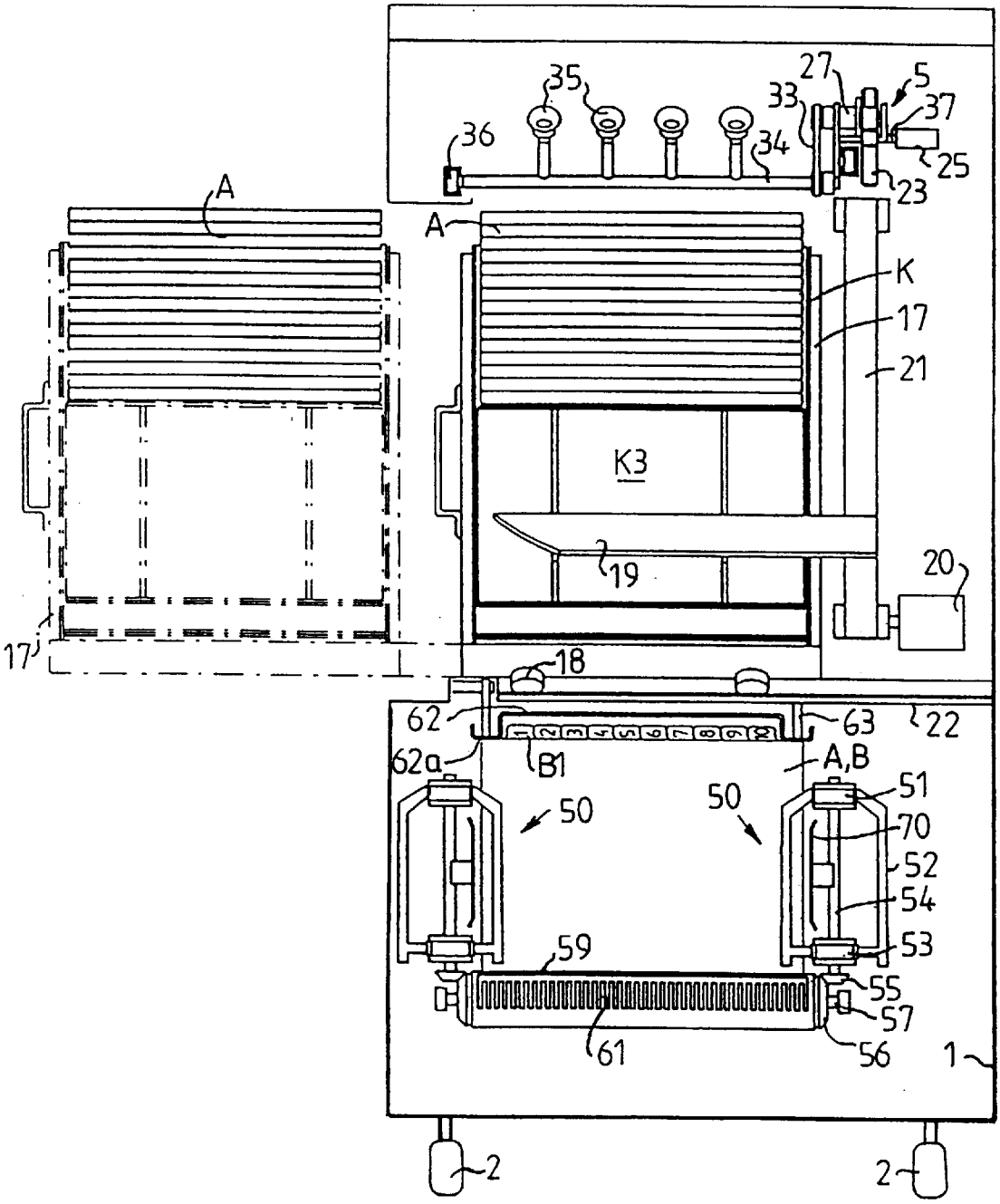
FIG. 2 is a sectional view taken on the line II—II in FIG. 1.

The sheet bundle B is, as a rule, comprised of a set of paper sheets that are not joined together and that have mutually the same size (A-4). The sheet bundle B may also include so-called registration sheets having parts on which letters and/or numbers are printed and which project beyond the remaining sheets in the bundle. FIG. 2 illustrates one such bundle with ten registration sheets B1 provided with number 1–10. As will be evident from the Figure, the registration sheets B1 are configured so that no parts will project beyond the upper side edge of the sheet bundle B in the two regions nearest both end edges of the bundle.

Each of the covers A is comprised of a sheet of board and/or plastic material that is provided with fold lines along which the sheet is folded and which delimit two cover sheets and a spine therebetween. A binder is applied to the inner surface of the spine. As a rule, the binder is comprised of a strip of thermoplastic material which is solid at room temperature but which softens when heated.

A large number of covers A are packed in containers or cassettes K that are intended for insertion into the machine in the illustrated manner, described in more detail hereinafter. Each cassette K is comprised of a box made of paperboard or like material and closed during storage and transportation. Although not shown, the cassette is provided with weakenings which enable part of the cassette to be removed to expose an opening K1 through which the covers A can be removed from the cassette. The cassette K includes opposite the opening K1 an abutment means K2 which functions to centre the covers in the cassette and which may be an integral part thereof. The cassette K also includes a support element K3, preferably in the form of a paperboard wedge, which extends between two cassette side-walls and which can be moved obliquely up and down in the cassette, as seen in FIG. 1.

An empty cassette K is filled with covers A by inserting thereinto, e.g. through the bottom of the cassette, a bundle of covers which are in mutual abutment and take a V-shape. The wedge K3 is the also inserted through the bottom of the cassette and into the space in the innermost cover. The bottom is then closed. In the filled cassette K, the outermost cover A lies against the abutment K2 and against a cassette part (not shown) which is identical with the abutment and which is later removed when opening the cassette to expose the opening K1. This cover lies, in turn, against a further cover such that the binding agent on the spine of the first-mentioned cover will be located opposite to and in contact with, or at a short distance from, the outer surface of the spine of this latter cover. The abutment K2, the aforesaid cassette part and the wedge K3 ensure that the covers are centred in the cassette and retain their V-configuration.

Shown in the drawings are two parallelepipedic cassettes K with the lids removed, said cassettes being shown in juxtaposed relationship in the illustrated machine. More specifically, each cassette is removably inserted in a carriage 16 and 17 respectively which can be readily moved with the aid of wheels 18 and expanding bars 22, from a position shown in chain lines in FIG. 2 outwardly of the machine stand 1 to a position inside the machine, shown in full lines in FIGS. 1 and 2.

When one of the carriages 16, 17 carrying a cassette K is pushed into the machine, a sword 19 disposed in the machine penetrates one of the cassette sidewalls and enters the wedge K3 to the position shown in FIG. 2. The sword 19 is then moved upwards by a reversible motor 20, which is connected to the sword by means of a belt 21. This movement of the sword causes the wedge K3 to be moved upwards in the cassette while entraining the covers A as the sword 19 cuts a slot in the cassette side-wall. Cutting of the side-wall can be facilitated by perforating the side-wall. Alternatively, the cassette may initially be provided with such a slot. The sword, wedge and covers continue to move until the spine of the uppermost (outermost) cover A acts on a photocell means (not shown) disposed above the cassette K, whereupon the photocell delivers a signal that stops the motor 20.

Figure 3:
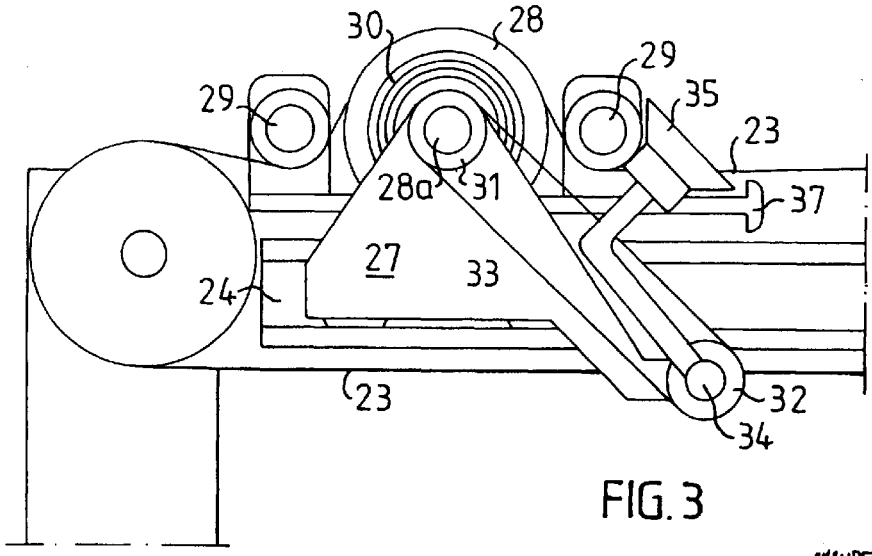
FIG. 3 is a side view in larger scale of the apparatus shown in FIGS. 1 and 2.

As will best be seen from FIG. 3, the apparatus 5 includes a reciprocatingly movable endless conveyor belt 23, which is driven by a reversible motor (not shown). A rail 24, a vertically movable projection 25 and a fixed projection 26 are disposed in the space between the upper and lower runs of the belt 23. A carriage 27 is horizontally movable on the rail 24. The carriage 27 supports a wheel 28. A helical spring 30 acts between the wheel 28 and the shaft 28A on which the wheel is rotatably mounted on the carriage. The belt 23 runs over the wheel 28 and beneath two rollers 29, each of which is rotatably mounted on a respective side of the wheel in the carriage 27. The shaft 28*a* carries a wheel 31. A long shaft 34 is rotatably mounted on the carriage 27. A wheel 32 is attached to the shaft 34. The wheels 31 and 32 are interconnected by means of an endless belt 33. The shaft 34 is hollow and carries four hollow arms provided with suction cups 35. That end of the shaft 34 which is not mounted in the carriage 27 is rotatably mounted on the machine stand 1 at 36. A vacuum source (not shown) is connected to the shaft at 36.

When the upper run of the belt 23 moves to the right in FIGS. 1 and 3, the carriage 27 is also moved in this direction. When a damping means 37 attached to the carriage strikes the stop 25, movement of the carriage will cease although the belt 23 will continue to move while turning the wheel 28 clockwise and tensioning the spring 30. The shaft 28*a* is also rotated during this rotation of the wheel 28. As a result of rotation of the wheel 28, and therewith the wheel 31, the wheel 32 will also be rotated through the medium of the belt 33, therewith rotating the shaft 34 and the suction cups 35 clockwise through an angle of about 180°. The suction cups 35 engage the uppermost cover A in the left-hand cassette K in FIG. 1 at the end of this movement, and when a desired vacuum has been obtained, a signal is sent to the drive motor of the belt 23 causing the direction of belt rotation to be changed. The tension in the spring 30 is released during this return movement of the belt 23, so as to rotate the shaft 34 back to its starting position shown in FIG. 3, wherewith the suction cups 34 remove the cover A from the cassette K. When the shaft 34 reaches its starting position, the carriage 27 begins to return to its starting position shown in FIG. 3. When the carriage has reached this position, a signal is sent to the vacuum source so as to interrupt suction in the suction cups 35, wherewith the cover is released and falls from the position shown in chain lines in FIG. 1 in the direction of arrow P3.

The stop means 25 may be moved from the position shown in FIG. 1, so as to allow the carriage 27 to move to a position in which the carriage is stopped by the projection 26 above the right-hand cassette K. This movement takes place in response to a signal delivered by the machine or in response to action on the part of the machine operator when covers are to be collected from the right-hand cassette, which will be done when the left-hand cassette is empty or when covers of a different size or of a different kind to those in the left-hand cassette are to be used instead.

The assembling device 4 includes a holder or a pit having two mutually opposing side-walls 38 and 39 that are angled at about 45° relative to one another. The bottom of the pit 38, 39 is delimited by a rotatable roller 40 driven by a motor (not shown) and including a shoulder 41 and a spring-driven counter-roller 44 which is freely rotatable towards the roller 40. The side-walls 38 and 39 carry respectively a fixed suction cup 42 and a movable suction cup 43 which are connected to a vacuum source not shown.

When the device 5 delivers a cover A, the cover falls down into the device 4 in a partially open state. The cover is maintained in this partially open state by the activated suction cups 42 and 43. When the spine of the cover A is in abutment with the shoulder 41, the arm 11 is swung in the direction of arrow P1 and the platform in the direction of arrow P2, so as to place the paper bundle B in the cover with one side edge of the papers in contact with the inner surface of the spine, as shown in full lines in FIG. 1. The holding means 15 is then actuated so as to release its engagement with the bundle B, whereupon the arm 11 and the platform 10 are returned to their respective positions shown in broken lines in FIG. 1.

The roller 40 is then rotated anti-clockwise, wherewith the shoulder 41 moves out of contact with the spine of the cover A. The counter roll 44 is then moved to the right in FIG. 1 and firmly clamps the cover A with the inwardly lying bundle B against the periphery of the roller 40 above the shoulder 41. The cover and the paper bundle are moved in the direction of the arrow P4 as the rollers 41, 44 continue to rotate, and fall down into the inclined collecting device 6.

The device 6 includes a shelf 46 rotatably journalled around the shaft 45, said shelf being capable of supporting one or more covers A and enclosed paper bundles B. When the device 6 is swung clockwise around the shaft 45 to its vertical position shown in chain lines in FIG. 1, it delivers the cover or covers with enclosed bundle or bundles to the activator means 7.

The activator means 7 includes a transporter that comprises two identical, synchronously driven conveyors 50 each comprising two mutually identical toothed belts 51 that are interconnected by means of yokes 52. The shortest distance between the yokes of the two conveyors 50 is less than the height of a cover A. The two belts 51 of each conveyor 50 are driven by identical toothed wheels 53 that are mutually connected by shafts 54. The lower ends of the shafts 54 are provided with bevel gear wheels 55 which engage with bevel gear wheels 56 mounted on a shaft 57, one of which is rotated by a motor not shown. Each of the shafts 57 is provided with a respective roller 58. An endless belt 59 runs around the rollers 58 at a speed which is synchronized with the speed of the conveyors 50. A heating means 60 and a cooling means 61 are disposed between the two runs of the belt 59.

A cover A, or several covers A, enclosing respective sets or bundles of papers B and inserted between the conveyors 50 by the device 60 are collected by the yoke 52 and the belt 59 as the transporter moves to the right in FIG. 1. FIG. 2 shows a cover A with a bundle of papers B resting on the belt 59 and located between two pairs of opposing yokes 52. The spacing between two mutually adjacent yokes 52 in each conveyor 50 is selected to accommodate several covers A of small spine width and with enclosed sheet bundles B accommodated between said covers, or two accommodate a cover of the largest spine width with an enclosed bundle of paper sheets.

As the covers A and paper bundles B are transported through the actuator means 7, the thermoplastic glue strings on the inner surface of respective spines are heated by the heating means 60, causing the glue to melt and the paper sheets to sink thereinto. Subsequent hereto, the covers are moved away from the heating means to the cooling means 61 in which the glue strings solidify and therewith bind the paper sheets B to the inner surfaces of respective spines. The paper sheets B are jogged as the covers A and paper bundle B pass through the heating part of the means 7, i.e. over the device 60, so as to straighten out respective sheet edges.

The sheet jogging device includes a plate 62 having two recessed side-parts 62*a* which are spaced apart by a distance slightly smaller than the height of a pillar A and a sheet bundle B, and slightly greater than those parts of the registration sheets B1 in the sheet bundle that project beyond the edge of the sheet bundle and the cover remote from the cover spine. The plate 62 is connected with two arms 63 that are journalled in the machine stand 1 and swung by a motor (not shown) between an upper position distanced from the covers and the sheet bundles in the device 7, and a lower position in which the parts 62*a* press against the two regions of the covers and the sheet bundles that are located on respective sides of the registration sheet B1. This latter position is shown in FIGS. 1 and 2. The extension of the plate 62 in the longitudinal direction of the device 7 is greater than the distance between a plurality of yokes 52, so as to enable several covers and sheet bundles to be jogged simultaneously each time the plate 62 is swung thereagainst.

A second jogging device includes two mutually spaced plates 70 that are moved repeatedly towards and away from the vertical side edges of the covers A and the sheet bundles B in FIG. 2 by drive means (not shown), to ensure that these side edges are located in respective vertical planes.

The finished booklets H are handled by the transporter means 9 when leaving the device 7.

The transporter means 9 includes two mutually spaced endless conveyor belts 64 which run around two rollers 65 and 66, of which one is driven by a motor not shown. The belts 64 are provided with several shelves 67 which project equidistantly from one another. When one or more finished booklets H leave the belt 59 and the yokes 52 are located in the movement path of a shelf 67, which is driven synchronously with the belt 59 and the yoke 52, this booklet or these booklets will be captured by said shelf and conveyed upwards until the shelf is located opposite the roller 66, at which position a motor driven device 68 that works synchronously with the belt 64 transfers the booklet (booklets) to an inclined surface 69 on the machine stand. The booklet, booklets, is/are available on this surface 69 for removal from the machine.

Figure 4:
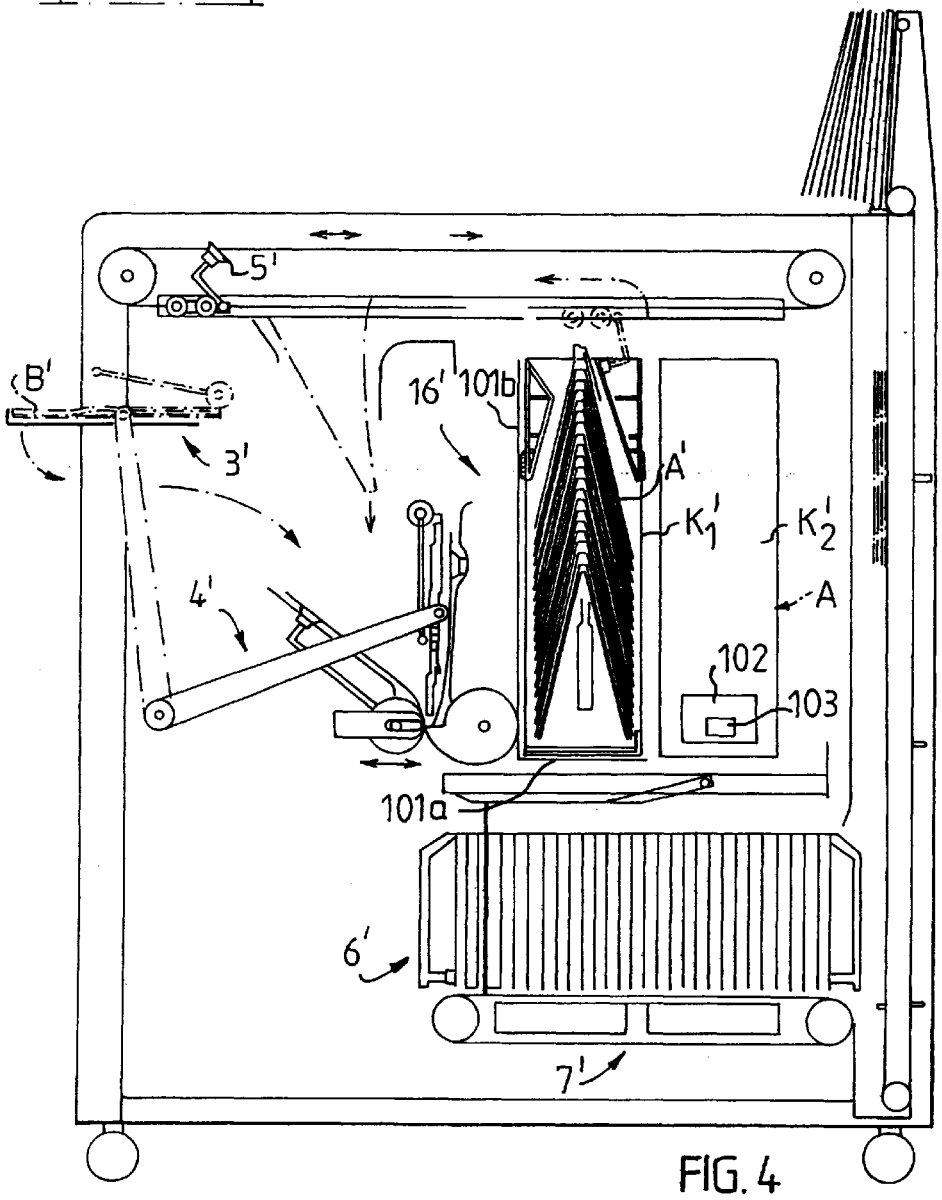
FIG. 4 is a schematic side view of inventive apparatus.

FIG. 4 illustrates the inventive arrangement in a view similar to the view in FIG. 1, but is more schematic with several components omitted with the intention of illustrating the particular features of the present invention more clearly.

The carriage 16' which functions as a holder for a cassette K' includes a horizontal bottom 101*a* and vertical side-walls 101*b* for handling the cassette $K_1'$ in a vertical position, with an upwardly facing opening that provides access to the covers A' in the cassette. The covers are stacked one upon the other in an inverse V configuration, with the cover sheets of each cover disposed symmetrically in relation to a plane that extends vertically through the apices of respective Vs. Each cover thus rests solely against the pack of covers located therebeneath. When the suction cup 5' is moved to the uppermost cover in the stack, in the manner described with reference to FIG. 1, the cover is drawn against the suction cup and lifted thereby from the cassette $K_1'$.

Located adjacent the cassette $K_1'$ used at that time is a replacement cassette $K_2'$, which also extends vertically with vertically disposed covers. The replacement cassette is marked at 102 with a code that denotes the thickness of the cover, conveniently defined as the width of the spine. The marked surface includes a code which can be read either mechanically or manually and which may be a bar code or magnetic code or a colour code, or a combination of characters, digits and/or letters that denote the type of covers in the cassette. The marked surface 102 may be a surface on the cassette $K_2'$ itself or comprise a label or the like removably attached to the cassette. The cassette $K_1'$ is also provided with a marked surface.

Figure 5:
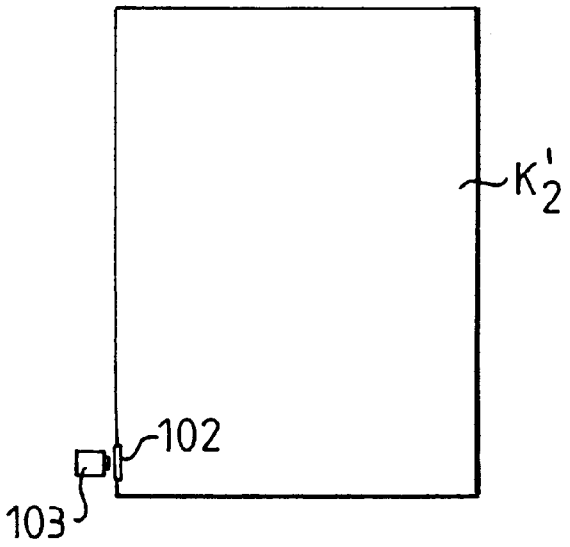
FIG. 5 is an end view of part of the apparatus shown in FIG. 4.

The illustrated embodiment includes an optical reader 103 located opposite the code and functioning to detect the contents of the cassette. The reader is also shown in FIG. 5, adjacent the cassette $K_2'$.

Figure 6:
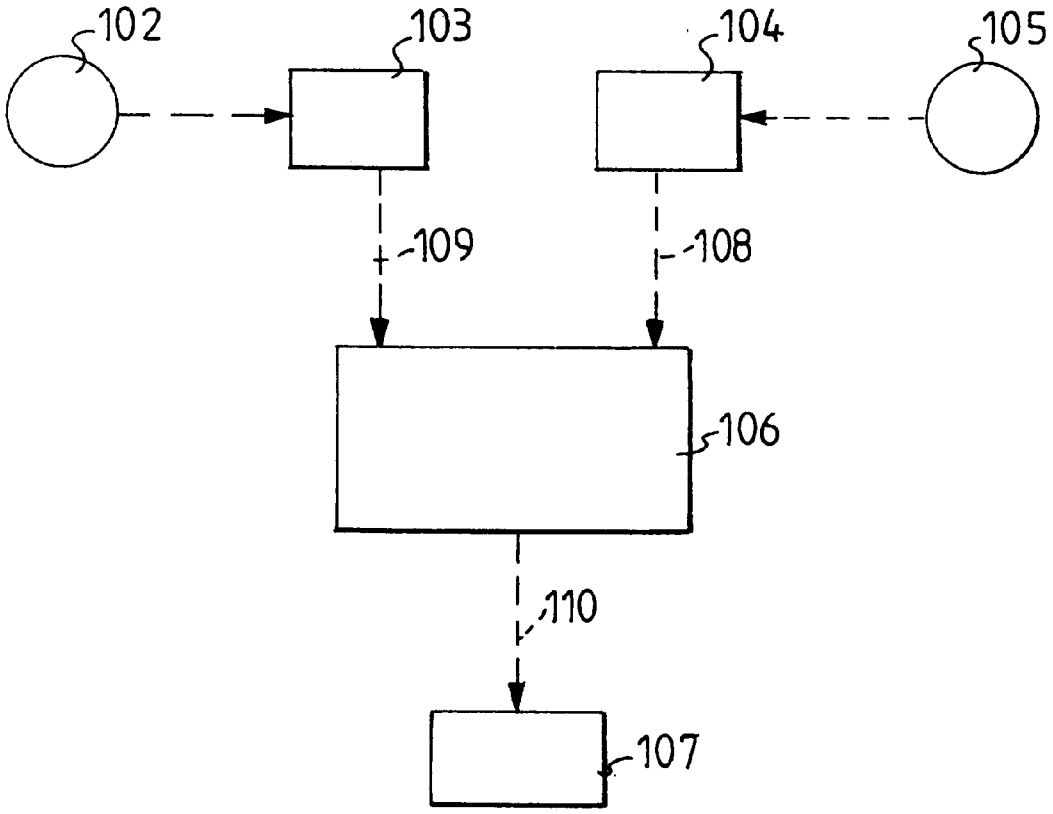
FIG. 6 is a block schematic that illustrates a part of one embodiment of the invention.

FIG. 6 is a schematic illustration of the manner in which the coding system is used to avoid using the wrong cover size in respect of a given sheet bundle. The thickness of the sheet bundle 104 is detected by detecting means 105 which deliver a signal 108 to a data processing unit 106, in which the signal is converted and stored as a control value. The reader 103 that reads the cassette code 102 sends a signal 109 to the data processing unit 106, in which the signal is compared with the stored control value. A control signal is sent from the unit 106 to a suitable operating means, for instance a switch, which will initiate the binding operation of the machine or prevent the binding operation from taking place, depending on whether the signal deriving from the code coincides with the control value or not. Alternatively, the signal 106 that generates the control value may be generated directly from a machine that is located upstream of the binding device and that delivers the sheet bundles, for instance a copier, said signal being generated by the counting mechanism of the copier, for instance.

What is claimed is:

1. A method of producing booklets, each having a cover that comprises two cover sheets and a spine disposed therebetween, a glue string applied to the inner surface of the spine, and a sheet bundle inserted between the two cover sheets of said cover and affixed at one side edge to the inner surface of the spine by means of said glue string, said method comprising the steps of a) placing the covers in a position of readiness in which the cover sheets of respective covers are located in planes that intersect one another along a generally horizontal intersection line;

b) moving a sheet bundle with the sheets not joined to a first position by a first power operated transport means;

c) bringing the sheet bundle into contact with the glue string of one of said covers, so as to enclose the sheet bundle with said side edge of the bundle facing towards the glue string; and d) moving the cover and the enclosed sheet bundle relative to an activator that functions to activate the glue string so as to bind said side edge of the sheet bundle to the inner surface of the spine, wherein each cover is placed in a position of readiness in which the cover sheets are located symmetrically in relation to a vertical plane through said intersection line; and wherein each cover is given a distinguishing mark which identifies the cover with respect to a distinguishing characteristic thereof.

2. A method according to claim 1, wherein each cover is positioned so that said planes mutually intersect at an acute angle.

3. A method according to claim 1, wherein each cover is placed in a position of readiness in which the spine lies in a horizontal plane.

4. A method according to claim 1, wherein said intersection line is located above the cover.

5. A method according to claim 1, wherein the covers are placed in a position of readiness enclosed in a cassette.

6. A method according to claim 5, where the cassette is parallelepipedic and is positioned vertically in said position of readiness.

7. A method according to claim 1, where the distinguishing mark is applied individually on each cover.

8. A method according to claim 1, wherein each cover is identified with a distinguishing mark that denotes a characteristic of the cover in relation to the characteristics of identical covers placed in a position of readiness enclosed in a cassette and wherein said distinguishing marks are applied at said cassettes.

9. A method according to claim 1, wherein each cover is identified through a distinguishing mark that denotes a characteristic of the cover with respect to the characteristics of identical covers placed in a position of readiness and enclosed in a cassette, and wherein the distinguishing marks are applied by an identification means corresponding to the cassette but separable therefrom.

10. A method according to claim 1, wherein said characteristic is the width of the spine.

11. A method according to claim 1, wherein the distinguishing mark is read automatically, wherein a signal representing the read distinguishing mark is generated, wherein the signal is compared with a control value, and wherein production is stopped when the signal deviates from said control value.

12. A method according to claim 11, wherein the control value is dependent on a parameter related to said sheet bundle.

13. A method according to claim 12, wherein said parameter is at least related to the thickness of the bundle or to the number of sheets therein.

14. A method according to claim 11, in which said characteristic is identified by any one of the means in the following group of means: magnetic code, color code, letter code, digit code and character code as the distinguishing mark.

15. A device for assembling booklets which each comprise a cover having two cover sheets and a spine therebetween, a glue string applied to the inner surface of the spine, and a sheet bundle inserted between the two cover sheets of said cover with one side edge joined to the inner surface of the spine by means of said glue string, wherein the device comprises:

a) at least one cover magazine that includes support means for bringing the covers to a readiness position in which each cover sheet of each cover is located in a respective plane and wherein said planes intersect one another along a generally horizontal intersection line;

b) a first power-driven transport means for moving a sheet bundle to a first position with the sheets of said bundle not joined together;

c) an assembly means for assembling the sheet bundle in the cover provided with said glue string;

d) a movable pick-up means for picking up the cover containing said glue string and said sheet bundle, with the side edge of said sheet bundle in abutment with the glue string;

e) activator means for activating the glue string during movement of the pick-up means or the activator means such as to bind the side edge of the sheet bundle to the inner surface of the spine; and f) the support means being adapted to bring the covers to a position of readiness in which the cover sheets of each cover are located symmetrically in relation to a vertical plane that extends through said intersection line.

16. A device according to claim 15, in which said planes mutually intersect at an acute angle.

17. A device according to claim 15, wherein said support means include a cassette holder and a cassette that can be removed from the remainder of the device.

18. A device according to claim 15, wherein the support means are adapted to bring the covers to a position of readiness in which the spine of each cover is located in a horizontal plane.

19. A device according to claim 15, wherein the support means are adapted to bring the covers to a position of readiness in which said intersection line is located above respective covers.

20. A device according to claim 17, wherein the cassette is parallelepipedic, and wherein the cassette holder is adapted to hold the cassette in a vertical position.

21. A device for producing booklets wherein each booklet is comprised of a cover having two cover sheets and a spine there-between, a glue string applied to the inner surface of the spine, and a sheet bundle inserted between the two cover sheets with one side edge of the bundle joined to the inner surface of the spine by means of the glue string, wherein the device comprises:

a) at least one cover magazine which includes support means for bringing the covers to a position of readiness in which each cover sheet of each cover is located in a respective plane, wherein the planes mutually intersect along a generally horizontal intersection line;

b) a first power-driven transport means for moving a sheet bundle to a first position with the sheets not joined together;

c) an assembly means for assembling the sheet bundle with the cover having said glue string;

d) a movable pick-up means for picking up the cover provided with said glue string and said sheet bundle, with one side edge of the bundle in abutment with the glue string;

e) activator means for activating the glue string during movement of the pick-up means or of the activator means such as to bind said side edge with the inner surface of the spine; and f) code reading means for reading a distinguishing mark that identifies a significant characteristic of each cover.

22. A device according to claim 21, in which the two planes mutually intersect at an acute angle.

23. A device according to claim 21, in which the code reading means is adapted to read a distinguishing mark provided on each individual cover.

24. A device according to claim 21, in which the support means include a cassette that can be removed from the remainder of the apparatus, and in which the code reading means is adapted to read a distinguishing mark applied at the cassette.

25. A device according to claim 21, further comprising signal transmission means for transmitting signals from the code reading means, data processing means for comparing said signals with a control value, and operating means for stopping operation of the device when the signal deviates from the control value.

26. A device according to claim 25, further comprising means for detecting a parameter of the sheet bundle, such as its thickness or the number of sheets in the bundle, and means for transmitting the value of said parameter to the data processing means for obtaining said control value.

27. A device according to claim 21, in which the code reading means is adapted to read a code of one of the following kinds: bar code, magnetic strip, color code or digit combination, letter combination or character combination.

28. A cassette for use in a method according to claim 1, wherein the cassette is provided with a code that is applied directly at the cassette.

29. A cassette according to claim 28, in which the code represents a characteristic of the covers stored in the cassette, the characteristic being the thickness of the spine of the covers.

30. A device according to claim 21, in which the support means include a cassette that can be removed from the remainder of the apparatus, and in which the code reading means is adapted to read a distinguishing mark applied on an identification means corresponding to the cassette but separable therefrom.

31. A cassette for use in a method according to claim 1, wherein the cassette is provided with a code that is applied by means that can be detached therefrom.

* * * * *